US010577948B2

(12) United States Patent
Smarsly et al.

(10) Patent No.: US 10,577,948 B2
(45) Date of Patent: Mar. 3, 2020

(54) TURBINE BLADE AND AIRCRAFT ENGINE COMPRISING SAME

(71) Applicant: MTU Aero Engines AG, Munich (DE)

(72) Inventors: Wilfried Smarsly, Munich (DE); Markus Fried, Valley (DE); Thomas Goehler, Dachau (DE)

(73) Assignee: MTU AERO ENGINES AG, Munich (DE)

( * ) Notice: Subject to any disclaimer, the term of this patent is extended or adjusted under 35 U.S.C. 154(b) by 1254 days.

(21) Appl. No.: 14/926,846

(22) Filed: Oct. 29, 2015

(65) Prior Publication Data

US 2017/0122256 A1 May 4, 2017

(51) Int. Cl.
*F01D 5/28* (2006.01)
*F01D 11/18* (2006.01)

(52) U.S. Cl.
CPC ..... *F01D 5/28* (2013.01); *F01D 11/18* (2013.01); *F05D 2300/131* (2013.01); *F05D 2300/175* (2013.01)

(58) Field of Classification Search
CPC ..... F01D 5/28; F01D 11/18; F05D 2300/131; F05D 2300/175; F02K 3/04; F02K 3/06; F02C 3/04; F02C 3/107; F02C 7/36
USPC ..... 60/226.1
See application file for complete search history.

(56) References Cited

U.S. PATENT DOCUMENTS 4,719,080 A * 1/1988 Duhl ..... C30B 11/00 148/404
4,744,725 A * 5/1988 Matarese ..... C23C 4/18 415/173.4
5,868,876 A * 2/1999 Bianco ..... C22C 32/0031 148/407
6,410,153 B1 * 6/2002 Broomfield ..... C22C 19/057 416/241 R
6,444,057 B1 * 9/2002 Darolia ..... C22C 19/057 148/428
8,425,836 B1 * 4/2013 Bhowmik ..... C22C 27/06 148/423
2002/0182070 A1 * 12/2002 Bewlay ..... B23K 1/0018 415/200
2005/0196268 A1 * 9/2005 Shah ..... C22C 19/056 415/20
2010/0014983 A1 * 1/2010 Takahashi ..... F01D 5/145 416/241 R
2012/0114479 A1 * 5/2012 Staubach ..... F02C 3/107 415/220
2012/0291449 A1 * 11/2012 Adams ..... F02C 7/36 60/793

(Continued)

OTHER PUBLICATIONS

PW1100G-JM First Flight, May 2013 [http://www.purepowerengines.com/photos.htm#gallery5 accessed on Dec. 20, 2017].*

(Continued)

*Primary Examiner* — Mark A Laurenzi
*Assistant Examiner* — Loren C Edwards
(74) *Attorney, Agent, or Firm* — Abel Schillinger, LLP

(57) ABSTRACT

The invention relates to a blade for use in a turbine of an aircraft engine. The blade is made of (a) a Mo-based alloy strengthened by intermetallic silicides or (b) a Ni-based single crystal superalloy. An aircraft engine and in particular, a turbofan aircraft engine including a corresponding turbine blade is also disclosed.

19 Claims, 1 Drawing Sheet

(56) References Cited

U.S. PATENT DOCUMENTS

| | | | | |
|---|---|---|---|---|
| 2013/0192196 | A1* | 8/2013 | Suciu | F02K 3/06 60/226.1 |
| 2016/0017797 | A1 | 1/2016 | Rued et al. | |
| 2016/0032826 | A1 | 2/2016 | Rued et al. | |

OTHER PUBLICATIONS

PW1100G-JM Secondary Airflow and Lubrication Systems, Pratt & Whitney, Aug. 2014.*

PW1100G-JM Engine [http://www.prattwhitney.com/Content/Press_Kits/pdf/ce_pw1100g_pCard.pdf accessed on Dec. 20, 2017].*

Engber, et al., "Advanced Technologies for Next Generation Regional Jets—Survey of Research Activities at MTU Aero Engines", ISABE-2007-1282, Proceedings: XVIII International Symposium on Air Breathing Engines (ISABE), 18th ISABE Conference, Beijing, China, Sep. 2-7, 2007, pp. 1-11.*

"The Jet Engine", Third Edition, Rolls-Royce Limited, 1969, pp. 9-14.*

T. T Sossaman et al., Influence of Minor Fe addition on the oxidation performance of Mo—Si—B alloys, Scripta Materialia 67 (2012) pp. 891-894.*

Daniel Schliephake et al., High-Temperature Creep and Oxidation Behavior of Mo—Si—B Alloys with High Ti Contents, Metallurgical and Material Transactions A vol. 45A, Mar. 2014, pp. 1102-1111.*

Cverna, Fran. (2002). ASM Ready Reference—Thermal Properties of Metals—2.2.3 Thermomechanical Analysis. (pp. 9-12). ASM International. Retrieved from https://app.knovel.com/hotlink/pdf/id:kt00URN4E4/asm-ready-reference-thermal/thermomechanical-analysis (Year: 2002).*

* cited by examiner

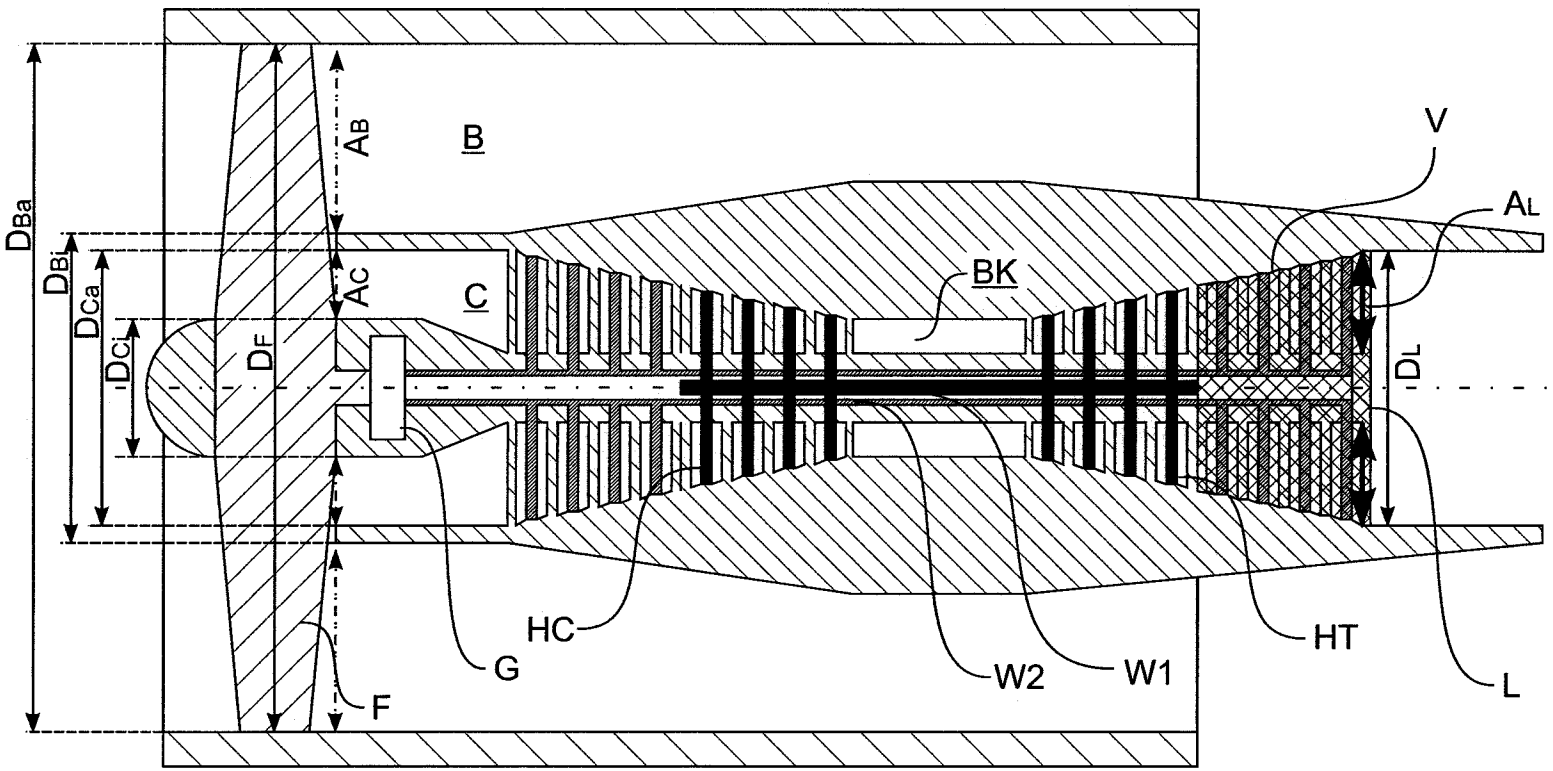
V
AL
DL
L
HT
W1
W2
BK
HC
G
B
C
AB
AC
F
DF
DCi
DCa
DBi
DBa

TURBINE BLADE AND AIRCRAFT ENGINE COMPRISING SAME

BACKGROUND OF THE INVENTION

1. Field of the Invention

The invention relates to a turbine blade and in particular, a blade for a gas turbine. The present invention also relates to a turbine comprising such a blade and an aircraft engine and in particular, a turbofan aircraft engine comprising a corresponding turbine. The present invention also relates to a method of reducing or eliminating the gap between a seal disposed on a flow-limiting wall of a turbine and a tip of a rotor blade or an outer shroud arranged on the rotor blade tip when the blade is at a temperature which is lower than the maximum operating temperature of the blade.

2. Discussion of Background Information

The materials currently employed for the blades of the first stage of a low pressure turbine are disadvantageous in that in the case of blades rotating at high speed or with high gas loads in the case of stationary vanes the creep resistance and tensile strength of these materials above about 1100° C. is insufficient. On the other hand, in order to further increase the efficiency of the currently available low pressure turbines (e.g., for high-speed turbofan aircraft engines) higher operating temperatures as well as higher rotating speeds are required. This causes a further increase in the thermal and mechanical stress of the components, in particular of the rotating blades and the stationary vanes of the first stages of the turbine. To reduce or prevent this increase in stress the components would have to be cooled, resulting in a decrease of efficiency and defeating the original purpose of increasing the efficiency.

Additionally, sealing systems in turbine components are to keep a gap between a rotating blade arrangement and a housing to a minimum and therefore are to guarantee a stable operation with a high degree of efficiency. Customarily, the rotating components of the turbine have sealing fins or sealing tips which, as is known, graze against or run in against seals disposed on the turbine wall, often honeycomb-shaped seals. For example, the rotating blades of the first stage of currently available low pressure turbines are usually made of materials such as Ni-based alloys which exhibit a thermal expansion coefficient of from $10\times10^{-6}$ to $18\times10^{-6}$ 1/K in the temperature range from 20 to 1200° C. During operation at high temperatures (e.g., at about 1100° C. or higher) the blades expand and graze against or run in against the seals disposed on the flow-limiting wall of the turbine. This prevents an undesirable pressure loss in the corresponding turbine stage. However, at lower temperatures the blades contract again, resulting in a gap between the seal and the blade tip and thus, a pressure drop. The low pressure turbine can thus, not completely convert the energy present in the pressure gradient into work, thereby causing a loss of efficiency.

In view of the foregoing, it would be desirable to have available a turbine blade and a turbomachine such as a low pressure gas turbine for an aircraft engine which remedies the problems set forth above.

SUMMARY OF THE INVENTION

The present invention provides a blade for a turbine of an aircraft engine. The blade is made of (a) a Mo-based alloy that is strengthened by intermetallic silicides or (b) a Ni-based single crystal superalloy.

In one embodiment of the blade of the present invention, the blade is made of an alloy (a). For example, alloy (a) may comprise molybdenum, silicon, boron and titanium as main constituents and one or both of iron and yttrium as minor alloying elements.

In one aspect of alloy (a), the alloy may comprise from 35 to 66 at. % of molybdenum. In another aspect, alloy (a) may comprise from 9 to 15 at. % of silicon and/or from 5 to 9 at. % of boron and/or from 25 to 33 at. % of titanium.

In yet another aspect, alloy (a) may comprise from 0.1 to 5 at. % of iron, e.g., from 0.3 to 3 at. % of iron, and/or from 0.1 to 5 at. % of yttrium, e.g., from 0.3 to 3 at. % of yttrium.

In a still further aspect, alloy (a) may additionally comprise one or more of zirconium, niobium, and tungsten as additional minor alloying elements. For example, alloy (a) may comprise up to 5 at. % of zirconium and/or up to 20 at. % of niobium and/or up to 8 at. % of tungsten.

In another aspect, alloy (a) may be formed exclusively by molybdenum, silicon, boron, titanium, iron, yttrium, niobium, tungsten, zirconium, or may be formed exclusively by molybdenum, silicon, boron, titanium, iron, yttrium, or may be formed exclusively by molybdenum, silicon, boron, titanium, iron.

In another aspect, alloy (a) may comprise a matrix of a molybdenum mixed crystal and one or more silicide phases. The one or more silicide phases may comprise $(Mo,Ti)_5Si_3$ and/or $(Mo,Ti)_5SiB_2$. For example, alloy (a) may comprise from 15 to 35 vol. % of $(Mo,Ti)_5Si_3$, from 15 to 35 vol. % of $(Mo,Ti)_5SiB_2$, and from 1 to 20 vol. % of one or more minor phases.

In another aspect, alloy (a) may comprise from 45 to 55 vol. % of molybdenum mixed crystal.

In another aspect, alloy (a) may exhibit a true density of less than or equal to 9 g/cm$^3$ and/or a thermal expansion coefficient in the temperature range from 20 to 1200° C. of not higher than $9\times10^{-6}$ 1/K.

In another embodiment of the blade of the present invention, the blade is made of an alloy (b).

In one aspect, alloy (b) may comprise, in % by weight, from 3.7 to 7.0 Al, from 10 to 20 Co, from 2.1 to 7.2 Cr, from 1.1 to 3.0 Mo, from 5.7 to 9.2 Re, from 3.1 to 8.5 Ru, from 4.1 to 11.9 Ta, from 2.1 to 4.9 W, from 0 to 3.3 Ti, from 0 to 0.05 C, from 0 to 0.1 Si, from 0 to 0.05 Mn, from 0 to 0.015 P, from 0 to 0.001 S, from 0 to 0.003 B, from 0 to 0.05 Cu, from 0 to 0.15 Fe, from 0 to 0.15 Hf, from 0 to 0.015 Zr, from 0 to 0.001 Y, remainder Ni and unavoidable impurities, the weight ratio Ta:Al being from 1:1 to 2:1, and the weight ratio Co:W being from 2:1 to 5:1. For example, in such an alloy (b) the weight ratio Co:W may be from 2:1 to 1:1 and/or the weight ratio W:Mo may be from 1:1 to 4:1 and/or the weight ratio Co:Re may be from 1:1 to 2:1 and/or the alloy may comprise one or more of, in % by weight, from 5.0 to 7.0 Al, from 10.5 to 15 Co, from 4.0 to 6.0 Cr, from 1.1 to 2.5 Mo, from 5.5 to 7.0 Re, from 3.1 to 5.5 Ru, from 5.0 to 9.0 Ta, from 3.0 to 4.5 W, from 0 to 2.0 Ti, e.g., one or more of from 5.5 to 6.0 Al, from 11.0 to 12.0 Co, from 4.5 to 5.5 Cr, from 1.1 to 2.0 Mo, from 5.7 to 6.5 Re, from 3.3 to 5.0 Ru, from 5.5 to 8.0 Ta, from 3.5 to 4.5 W, from 0.5 to 2.0 Ti.

In another aspect, alloy (b) may exhibit a density of not more than 9.1 g/cm$^3$ and/or a thermal expansion coefficient of the alloy in the temperature range from 20 to 1200° C. of not higher than $9\times10^{-6}$ 1/K.

In yet another aspect, alloy (b) may comprise a $\gamma$ matrix and $\gamma'$ precipitates, the proportion of W and/or Mo in the matrix being higher than the proportion of W and/or Mo in the precipitates.

The present invention also provides a turbine for a turbomachine and in particular, for an aircraft engine and a turbomachine and in particular, an aircraft engine which comprises such a turbine. The turbine comprises at least one blade according to the present invention as set forth above (including the various aspects thereof).

In one aspect, the aircraft engine may comprise (i) a first turbine and (ii) a second turbine disposed downstream of (i) and having a plurality of turbine stages, and at least the first stage of the plurality of turbine stages may comprise at least one blade according to the present invention as set forth above (including the various aspects thereof).

In another aspect of the above aircraft engine, (i) may be a high-pressure turbine and/or (ii) may be a low-pressure turbine.

In yet another aspect of the above aircraft engine, the blades of the first stage of (ii) may not be cooled and/or all rotor blades and/or all stator blades of the first stage of (ii) may be made of alloy (a) and/or of alloy (b) and/or all rotor blades and/or all stator blades of all stages of (ii) which are different from the first stage may be made of a material that is different from alloy (a) and from alloy (b). For example, the material that is different from alloy (a) and from alloy (b) may comprise a Ti-based material.

In a still further aspect, the aircraft engine of the present invention may be a turbofan aircraft engine. For example, the turbofan aircraft engine may comprise a primary duct including a combustion chamber; the first turbine (i) disposed downstream of the combustion chamber; a compressor disposed upstream of the combustion chamber and coupled to the first turbine; and the second turbine (ii) disposed downstream of the first turbine (i) and coupled (for example, via a speed reduction mechanism) to a fan for feeding a secondary duct of the aircraft engine.

In one aspect of the above turbofan aircraft engine, the square of the ratio of the maximum blade diameter of the fan to the maximum blade diameter of the second turbine may be at least 3.5. For example, the ratio may be at least 4 and/or may be at least equal to the sum of one and a quotient of the bypass area ratio of the inlet area of the secondary duct to the inlet area of the primary duct divided by not more than 3.6, e.g., divided by not more than 3.2, divided by not more than 2.8, or divided by not more than 2.6.

In yet another aspect of the turbofan aircraft engine of the present invention, the sum of the product of the square of the maximum blade diameter of the fan in [$m^2$] and at least 0.1 m, the product of the maximum blade diameter of the fan in [m] and at most −0.1 $m^2$, and at most 0.5 $m^3$ may in its absolute value be at least equal to the volume of the outer wall of the second turbine between the entrance cross section and the exit cross section in [$m^3$] thereof. Additionally, the sum of the product of the square of the maximum blade diameter of the fan in [$m^2$] and 0.15 m, the product of the maximum blade diameter of the fan in [m] and −0.28 $m^2$, and 0.2 $m^3$ may in its absolute value be at least equal to the volume of the outer wall of the second turbine between the entrance cross section and the exit cross section in [$m^3$] thereof.

In a still further aspect of the above turbofan aircraft engine, the maximum blade diameter of the fan may be at least 1.2 m and/or the second turbine may have not more than 5 stages, for example, not more than 4 stages.

In another aspect of the turbofan aircraft engine of the present invention, the product of the exit area of the second turbine in square inches and the square of the maximum allowable operating speed of the second turbine in rpms may be at least 8,000 $m^2/s^2$, for example, at least 9,000 $m^2/s^2$.

In another aspect of the above turbofan aircraft engine, with the second turbine having a total stage count ($n_{St}$) of all turbine stages, a total blade count ($N_{BV}$) of all rotor blades and stator blades of all turbine stages, a stage pressure ratio (Π) of the pressure at the inlet to the pressure at the outlet at each turbine stage, and a total pressure ratio ($p_1/p_2$) of the pressure at the inlet of the first turbine stage to the pressure at the exit of the last turbine stage of the second turbine at a design point, the quotient ($N_{BV}/110$) of the total blade count divided by 110 may be less than a difference ($[(p_1/p_2)-1]$) of the total pressure ratio minus one, with the total pressure ratio being greater than 4.5; and at least one stage pressure ratio, e.g., each stage pressure ratio, may be at least 1.5; and the turbine may have at least two and not more than five turbine stages; and/or the quotient ($(p_1/p_2)/n_{St}$) of the total pressure ratio divided by the total stage count may be greater than 1.6.

Additionally, the quotient ($N_{BV}/100$) of the total blade count divided by 100 may be less than the difference of the total pressure ratio minus one; and/or the total pressure ratio may be greater than 5; and/or at least one stage pressure ratio, e.g., each stage pressure ratio, may be at least 1.6, e.g., at least 1.65; and/or the turbine may have not more than four turbine stages.

Further, the product ($An^2$) of the exit area of the second turbine and the square of the rotational speed of the second turbine at the design point may be at least $4.5\cdot10^{10}$ [$in^2\cdot rpm^2$], and at least one stage pressure ratio, e.g., each stage pressure ratio, may be at least 1.5, and the blade tip velocity ($u_{TIP}$) of at least one turbine stage of the second turbine at the design point may be at least 400 meters per second. Even further, the product of the exit area of the second turbine and the square of the rotational speed of the second turbine may be at least $5\cdot10^{10}$ [$in^2\cdot rpm^2$] and/or at least one stage pressure ratio, e.g., each stage pressure ratio, may be at least 1.6, e.g., at least 1.65, and/or a blade tip velocity of at least one stage of the second turbine at the design point may be at least 450 meters per second.

Still further, the bypass area ratio of the inlet area of the secondary duct to the inlet area of the primary duct may be at least 7, e.g., at least 10. Further, the maximum blade diameter of the fan may be at least 1.2 m.

The present invention also provides a method of reducing or eliminating the gap between a blade tip and a seal in a gas turbine of a turbomachine (e.g., a gas turbine) at an operating temperature which is at least 100° C. below, e.g., at least 200° C. below the maximum operating temperature of the turbomachine of at least 1100° C. The method comprises using a blade according to the present invention as set forth above (including the various aspects thereof).

In one aspect of the method, the blade may be comprised in the first stage of a plurality of stages of a second turbine of an aircraft engine (for example, a turbofan aircraft engine) which comprises a first turbine upstream of the second turbine. For example, the first turbine may be a high-pressure turbine and the second turbine may be a low-pressure turbine.

In another aspect, the a thermal expansion coefficient of the blade in a temperature range from 20 to 1200° C. may be not higher than $9\times10^{-6}$ 1/K, e.g., not higher than $8\times10^{-6}$ 1/K, or not higher than $7\times10^{-6}$ 1/K.

Alloy (a)

As set forth above, the alloy (a) which can be used to make the blade of the present invention (in the instant specification and the appended claims the terms "blade" and "vane" may be used interchangeably) is a Mo-based alloy strengthened by intermetallic silicides. Non-limiting examples of corresponding alloys include the alloys which are disclosed in U.S. patent application Ser. No. 14/835,866, the entire disclosure of which is incorporated by reference herein.

The alloys disclosed in U.S. patent application Ser. No. 14/835,866 comprise molybdenum, silicon, boron and titanium as main constituents and one or both of iron and yttrium as minor alloying elements. These alloys may optionally further comprise one or more of zirconium, niobium, tungsten.

For example, a corresponding alloy (a) may comprise from 9 to 15 at. %, e.g., from 13 to 14 at. % of silicon and/or from 5 to 9 at. %, e.g., from 5 to 6 at. % of boron and/or at from 25 to 33 at. %, e.g., from 26 to 29 at. % of titanium.

Also way of example, such an alloy (a) may comprise iron and/or yttrium independently of each other at a concentration of from 0.1 to 5 at. %, in particular from 0.3 to 3 at. %. For example, iron may be present at a concentration of from 0.5 to 3 at. %, e.g., from 0.8 to 1.6 at. %, and/or yttrium may be present at a concentration of from 0.3 to 2 at. %, e.g., from 0.5 to 1.5 at. %.

If present, zirconium may, for example be present at a concentration of not more than 5 at. %, e.g., from 0.3 to 3 at. %, and/or niobium may be present at a concentration of not more than 20 at. %, e.g., from 0.3 to 15 at. %, and/or tungsten may be present at a concentration of not more than 8 at. %, e.g., from 0.3 to 5 at. %.

Molybdenum may be present in a corresponding alloy (a) at a concentration of, for example, from 35 to 66 at. %, e.g., from 40 to 55 at. %, or from 45 to 50 at. %, and/or at a concentration such that the alloy comprises 100 at. % together with the remaining alloying constituents mentioned.

Further, alloy (a) may be formed exclusively of molybdenum, silicon, boron, titanium, iron, yttrium, niobium, tungsten, zirconium, or it may be formed exclusively of molybdenum, silicon, boron, titanium, iron, yttrium.

Also, the microstructure of alloy (a) may comprise a matrix of a molybdenum mixed crystal and silicide phases, the silicide phases being formed in particular by $(Mo,Ti)_5Si_3$ and/or $(Mo,Ti)_5SiB_2$. For example, alloy (a) may comprise from 15 to 35 vol. %, e.g., from 25 to 35 vol. % of $(Mo,Ti)_5Si_3$ and from 15 to 35 vol. %, e.g., from 15 to 25 vol. % of $(Mo,Ti)_5SiB_2$ and from 1 to 20 vol. % of minor phases. Also by way of example, alloy (a) may comprise from 45 to 55 vol. %, e.g., from 48 to 55 vol. % of molybdenum mixed crystal and/or a fraction of molybdenum mixed crystal such that the alloy together with the remaining phase constituents comprises 100 vol. %.

The true density of alloy (a) (i.e., the density without any pores or cavities) may, for example, be not higher than 9 g/cm$^3$, e.g., not higher than 8.5 g/cm$^3$, or not higher than 8 g/cm$^3$. Further, the thermal expansion coefficient of the alloy in the temperature range from 20 to 1200° C. may, for example, be not higher than $9\times10^{-6}$ 1/K, e.g., not higher than $7\times10^{-6}$ 1/K, or not higher than $6\times10^{-6}$ 1/K and may, for example, be in the range of from $4\times10^{-6}$ 1/K to $9\times10^{-6}$ 1/K.

Further, in the above alloy (a) the element molybdenum makes up the greatest alloying fraction in at. % and/or vol. %. In other words, there is no other element present in alloy (a) which has a greater alloying concentration in at. % and/or vol. % than molybdenum.

Main alloying constituents of the above exemplary alloys (a) are intended to mean that the alloying elements which are present in any case in the alloy have the highest concentrations in the alloy. Minor alloying elements are intended to mean those alloying elements which either do not absolutely need to be present in the alloy or, if they are present in the alloy, are present in all cases only in a lower concentration.

The main alloying constituents can vary in differing ranges in alloy (a). For example, silicon may be present at a concentration of 9-15 at. %, e.g., 13-14 at. %, boron may be present at a concentration of 5-9 at. %, e.g., 5-6 at. %, and titanium may be present at a concentration of 25-33 at. %, e.g., 26-29 at. %.

As is known to those skilled in the art, an alloy can comprise further elements as unavoidable impurities. However, none of these further elements (i.e., elements different from those mentioned above) should make up more than 1 at. %, preferably more than 0.1 at. % in the alloy (a).

Molybdenum will usually be present in alloy (a) at a concentration of, for example, from 35-66 at. %, e.g., 40-55 at. %, or 45-50 at. %, and/or at a concentration such that the alloy affords 100 at. % together with the remaining alloying constituents mentioned.

Furthermore, the data with respect to the chemical composition of any alloys (a) and (b) mentioned herein are not to intended to mean that for each alloying element the maximum values or minimal values can be selected, but the range figures for the alloy composition merely indicate in which ranges the individual chemical elements can be present in the alloy, wherein the individual alloying elements can mutually replace each other in such a manner that when an alloying element is present in the range of its maximum concentration, other alloying elements are only present in the alloy at smaller concentration. In addition, the alloy comprises unavoidable impurities which are not explicitly stated.

With the main and minor alloying elements, therefore, the above alloy (a) can be formed which, in addition to unavoidable impurities, comprises exclusively Mo, Si, B, Ti, Fe, Y, Zr, Nb and/or W. In particular, Mo—Si—B—Ti—Fe—, Mo—Si—B—Ti—Fe—Zr—, Mo—Si—B—Ti—Fe—Y—, Mo—Si—B—Ti—Fe—Y—Nb— and Mo—Si—B—Ti—Fe—Y—Nb—W alloys can be formed, likewise a Mo—Si—B—Ti—Y alloy which does not comprise iron, although an alloy (a) containing iron is preferred in principle.

The microstructure of the above alloy (a) can be adjusted in such a manner that it comprises a matrix of molybdenum mixed crystal into which the silicide phases are incorporated; the silicide phases may comprise, e.g., by $(Mo, Ti)_5Si_3$ and/or $(Mo, Ti)_5SiB_2$. In the respective silicides, therefore, molybdenum can be replaced by titanium and vice versa.

By way of example, the above alloy (a) may comprise from 15 to 35 vol. %, e.g., from 25 to 35 vol. % of $(Mo,Ti)_5Si_3$ and from 15 to 35 vol. %, e.g., from 15 to 25 vol. % of $(Mo,Ti)_5SiB_2$ and from 1 to 20 vol. %, e.g., from 1 to 5 vol. % of minor phases. Minor phases can comprise various phases, in particular various mixed phases or mixed crystals of the alloying elements present in the alloy. Further, alloy (a) may additionally comprise, for example, from 45 to 55 vol. %, e.g., from 48 to 55 vol. %, molybdenum mixed crystal or a fraction of molybdenum mixed crystal such that the alloy together with the remaining phase constituents comprises 100 vol. %.

Here also, in a similar manner to the statements regarding chemical composition, the statements on the ranges of values of the phase constituents are not to intended to mean the maximum values or minimal values can be selected for every phase, but the range figures for the phase composition merely indicate in which ranges the individual phases can be present in the alloy, wherein the individual phases, depending on the composition and the production conditions, can be mutually exchanged within the stated limits Specific examples of alloys (a) which are suitable for use in the present invention are set forth below.

Alloy (b)

As set forth above, the alloy (b) which can be used from making the blade of the present invention is a Ni-based single crystal superalloy. Non-limiting examples of corresponding alloys include the alloys which are disclosed in European Patent Application No. 15181489.4, the entire disclosure of which is incorporated by reference herein.

The alloys disclosed in European Patent Application No. 15181489.4 comprise, in % by weight:

| | |
|---|---|
| Al | from 3.7 to 7.0 |
| Co | from 10 to 20 |
| Cr | from 2.1 to 7.2 |
| Mo | from 1.1 to 3.0 |
| Re | from 5.7 to 9.2 |
| Ru | from 3.1 to 8.5 |
| Ta | from 4.1 to 11.9 |
| W | from 2.1 to 4.9, |

wherein the weight ratio Ta:Al is from 1:1 to 2:1, and the weight ratio Co:W is from 2:1 to 5:1.

These alloys may further comprise, as optional components, one or more of the following, in % by weight:

| | |
|---|---|
| Ti | up to 3.3 |
| C | up to 0.05 |
| Si | up to 0.1 |
| Mn | up to 0.05 |
| P | up to 0.015 |
| S | up to 0.001 |
| B | up to 0.003 |
| Cu | up to 0.05 |
| Fe | up to 0.15 |
| Hf | up to 0.15 |
| Zr | up to 0.015 |
| Y | up to 0.001. |

The remainder of the above alloy (b) is constituted by Ni and unavoidable impurities.

For example, the above alloy (b) may show one or more, e.g., all elements in the following concentrations, in % by weight:

| | |
|---|---|
| Al | from 5.0 to 7.0, e.g., from 5.5 to 6.0 |
| Co | from 10.5 to 15.0, e.g., from 11.0 to 12.0 |
| Cr | from 4.0 to 6.0, e.g., from 4.5 to 5.5 |
| Mo | from 1.1 to 2.5, e.g., from 1.1 to 2.0 |
| Re | from 5.7 to 7.0, e.g., from 5.7 to 6.5 |
| Ru | from 3.1 to 5.5, e.g., from 3.3 to 5.0 |
| Ta | from 5.0 to 9.0, e.g., from 5.5 to 8.0 |
| W | from 3.0 to 4.5, e.g., from 3.5 to 4.5 |
| Ti | from 0.5 to 2.0, e.g., from 1.1 to 1.7 (if present at all). |

Ni is the main constituent of the above alloy (b), i.e., the component which exhibits the highest concentration of all the elements present in the alloy, both in at. % and % by weight. Regarding the numerical ranges set forth above and below, the same applies as set forth above with respect to the alloys (a).

The above alloys (b) are characterized by a weight ratio Ta:Al of from 1:1 to 2:1 because it has been observed that weight ratios in this range can improve the distribution of W and Mo between the γ matrix and the γ' precipitates, resulting in a concentration of W and/or Mo in the γ matrix which is higher than the concentration of W and/or Mo in the γ' precipitates.

Further, a weight ratio Co:W of from 2:1 to 5:1 usually makes it possible to achieve an improvement of the segregation behavior of the alloys (b), i.e., a lower casting segregation and a higher degree of homogenization, thereby allowing simpler and shorter heat treatment (annealing) cycles. In combination with an increased concentration of W in the γ matrix obtained by the above weight ratio of Ta and Al, it is possible to either increase the strength or, when keeping the mixed crystal solidification constant, reduce the total concentration of W, which is also advantageous in terms of the density of the alloy.

In addition to the weight ratios of Ta and Al and Co and W, the above alloy (b) can further be adjusted to result in a weight ratio W:Mo in the range from 1:1 to 4:1 and/or in a weight ratio Co:Re in the range from 1:1 to 2:1. Also in this case the favorable results set forth above may be observed.

The true density of alloy (b) (i.e., the density without any pores or cavities) may, for example, be not higher than 9.1 $g/cm^3$, e.g., not higher than 8.94 $g/cm^3$, not higher than 8.85 $g/cm^3$, or not higher than 8.8 $g/cm^3$. Further, the thermal expansion coefficient of the alloy in the temperature range from 20 to 1200° C. may, for example, be not higher than $9\times10^{-6}$ 1/K, e.g., not higher than $7\times10^{-6}$ 1/K, or not higher than $6\times10^{-6}$ 1/K and may, for example, be in the range of from $4\times10^{-6}$ 1/K to $9\times10^{-6}$ 1/K.

Specific examples of alloys (b) which are suitable for use in the present invention are set forth below.

Turbofan Aircraft Engine

As set forth above, the turbofan aircraft engine according to the instant invention comprises a primary duct including a combustion chamber; a first turbine (i) disposed downstream of the combustion chamber; a compressor disposed upstream of the combustion chamber and coupled to the first turbine; and a second turbine (ii) disposed downstream of the first turbine (i) and coupled to a fan for feeding a secondary duct of the aircraft engine.

In one embodiment, the turbofan aircraft engine according to the instant invention may be a turbofan aircraft engine as disclosed in U.S. patent application Ser. No. 14/335,107 and/or in U.S. patent application Ser. No. 14/450,882, the entire disclosures of which are incorporated by reference herein.

The turbofan aircraft engine disclosed in U.S. patent application Ser. Nos. 14/335,107 and 14/450,882 is a turbofan aircraft engine having a primary duct (C) including a combustion chamber (BK), a first turbine (HT) disposed downstream of the combustion chamber, a compressor (HC) disposed upstream of the combustion chamber and coupled (W1) to the first turbine, and a second turbine (L) disposed downstream of the first turbine and coupled via a speed reduction mechanism (G) to a fan (F) for feeding a secondary duct (B) of the turbofan aircraft engine.

In one aspect thereof, the turbofan aircraft engine thus has a primary gas duct (hereinafter also referred to as "primary duct") for a so-called "core flow". The primary duct includes a combustion chamber, in which, in one embodiment, air that is drawn-in and compressed is burned together with supplied fuel during normal operation. The primary duct includes a first turbine which is located downstream, in particular immediately downstream, of the combustion chamber and which, without limiting generality, is hereinafter also referred to as "high-pressure turbine". The axial location information "downstream" refers in particular to a through-flow during, in particular, steady-state operation and/or normal operation. The first turbine or high-pressure turbine may have one or more turbine stages, each including a rotor blade array and preferably a stator vane array downstream or upstream thereof, and is coupled, in particular fixedly connected, to a compressor of the primary duct such that they rotate at the same speed. The compressor is preferably disposed immediately upstream of the combustion chamber and, without limiting generality, is hereinafter also referred to as "high-pressure compressor". The high-pressure compressor may have one or more stages, each including a rotor blade array and preferably a stator vane array downstream or upstream thereof. The high-pressure compressor, combustion chamber and high-pressure turbine together form a so-called "core engine".

The turbofan aircraft engine has a secondary duct, which is preferably arranged fluidically parallel to and/or concentric with the primary duct. A fan is disposed upstream of the secondary duct to draw in air and feed it into the secondary duct. The fan may have one or more axially spaced-apart rotor blade arrays; i.e., rows of rotor blades distributed, in particular equidistantly distributed, around the circumference thereof. A stator vane array may be disposed upstream and/or downstream of each rotor blade array of the fan. In one embodiment, the fan is an upstream-most or first or forwardmost rotor blade array of the engine, while in another embodiment, the fan is a downstream-most or last or rearwardmost rotor blade array of the engine ("aft fan"). In one embodiment, the fan is adapted or designed to feed also the primary duct and/or is preferably disposed immediately upstream of the primary duct and/or the secondary duct. At least one additional compressor may be disposed between the fan and the first compressor or high-pressure compressor. Without limiting generality, the additional compressor is also referred to as "low-pressure compressor".

The fan is coupled via a speed reduction mechanism to a second turbine of the primary duct. The second turbine is disposed downstream of the high-pressure turbine and, without limiting generality, is hereinafter also referred to as low-pressure turbine. The second turbine or low-pressure turbine may have one or more turbine stages, each including a rotor blade array and preferably a stator vane array downstream or upstream thereof. In one embodiment, at least one additional turbine may be disposed between the high-pressure and low-pressure turbines. In one embodiment, the fan and the low-pressure turbine may be coupled via a low-pressure shaft disposed concentrically with a hollow shaft, which couples the high-pressure compressor and the high-pressure turbine. The speed reduction mechanism may include a transmission, in particular, a single- or multi-stage gear drive. In one embodiment, the speed reduction mechanism may have an in particular fixed speed reduction ratio of at least 2:1, in particular at least 3:1, and/or not greater than 11:1, in particular not greater than 4:1, between a rotational speed of the low-pressure turbine and a rotational speed of the fan. As used herein, a speed reduction mechanism is understood to mean, in particular, a non-rotatable coupling which converts a rotational speed of the low-pressure turbine to a lower rotational speed of the fan.

In accordance with one aspect of the above turbofan aircraft engine, the square $(D_F/D_L)^2$ wherein $D_F$ is the maximum blade diameter of the fan and $D_L$ is the maximum blade diameter of the second turbine or low-pressure turbine is at least 3.5, e.g., at least 3.7, or at least 4.

By selecting a suitable relationship between the initially substantially independent design parameters of maximum blade diameter of the fan and maximum blade diameter of the low-pressure turbine it is possible to design a turbofan aircraft engine that is particularly advantageous, in particular low-noise, efficient and/or compact. As used herein, the (maximum) blade diameter is understood to mean, in particular, the (maximum) radial distance between opposite blade tips; i.e., the (maximum) diameter of the (largest) rotor blade array.

Further, a particularly advantageous, in particular low-noise, efficient and/or compact turbofan aircraft engine can be designed if, in addition, or as an alternative, to this advantageous absolute value range, an initially substantially independent bypass area ratio $(A_B/A_C)$ of the inlet area $A_B$ of the secondary duct to the inlet area $A_C$ of the primary duct is taken into account in the selection of the square $(D_F/D_L)^2$. As used herein, the inlet area of the primary or secondary duct is understood to mean, in particular, the flow-through cross-sectional area at the inlet of the primary or secondary duct, preferably downstream, in particular immediately downstream, of the fan and/or at the same axial position.

In accordance with one aspect of the above turbofan aircraft engine, the sum $[1+(A_B/A_C)]/K$ defines an upper and/or lower limit for $(D_F/D_L)^2$. In particular, in one embodiment, $(D_F/D_L)^2$ is at least equal to $[1+(A_B/A_C)]$ divided by 3.6, e.g., divided by 3.2, divided by 2.8, or divided by 2.6. Preferably, $(A_B/A_C)$ is greater than 6.5.

Further, a particularly advantageous, in particular low-noise, efficient, light and/or compact turbofan aircraft engine can be designed if, in addition, or as an alternative, to these advantageous absolute or relative value ranges for $(D_F/D_L)^2$, an initially substantially independent volume V defined or bounded by an outer wall of the second turbine; i.e., of the primary duct between the entrance cross-section and the exit cross section of the second turbine, is designed, in particular limited, according to the parabolic function: $a \cdot D_F^2 + b \cdot D_F + c$.

Accordingly, in accordance with one aspect of the above turbofan aircraft engine, the sum $a \cdot D_F^2 + b \cdot D_F + c$ is, in its absolute value, at least equal to the volume V of the outer wall of the primary duct; i.e., of its second turbine between the entrance cross-section and the exit cross-section thereof, where constant "a" is at least 0.1 m, e.g., equal to 0.15 m, constant "b" is not greater than $-0.1\ m^2$, e.g., is equal to $-0.28\ m^2$, and constant "c" is not greater than $0.5\ m^3$, e.g., is equal to $0.24\ m^3$, and the maximum blade diameter $D_F$ in [m] and the volume V in [$m^3$] being:

$$V[m^3] \leq a \cdot D_F^2[m^2] + b \cdot D_F[m] + c \text{ where:}$$

$a \geq 0.1$ m, in particular a=0.15 m and
$b \leq -0.1\ m^2$, in particular $b=-0.28\ m^2$ and
$c \leq 0.5\ m^3$, in particular $c=0.24\ m^3$.

A detailed description of a turbofan aircraft engine according to an embodiment of the present invention is provided below with reference to the only FIG.

Further and as set forth in U.S. patent application Ser. No. 14/450,882, the number of all turbine stages of the second turbine, in particular of all axially spaced-apart rotor blade arrays that are coupled to the fan via the speed reduction mechanism, defines a total stage count of all turbine stages of the second turbine and the number of all rotor blades and stator vanes of all turbine stages of the second turbine together defines a total blade count of all rotor blades and stator vanes of the second turbine.

At a predetermined design point, each turbine stage of the second turbine has a (design) stage pressure ratio of the (design) pressure at the inlet to the pressure at the exit of this turbine stage. At the predetermined design point, the second turbine as a whole has a (design) total pressure ratio of the (design) pressure at the inlet of the upstreammost or first turbine stage to the (design) pressure at the exit of the downstreammost or last turbine stage of the second turbine.

This (design) total pressure ratio is, in particular, equal to the product of the stage pressure ratios of all turbine stages of the second turbine.

The predetermined design point may in particular be an operating point of the turbofan aircraft engine which, in one embodiment, may be defined by a predetermined rotational speed and/or a predetermined mass flow of air through the turbofan aircraft engine and which may in particular be the so-called "redline point"; i.e., an operating point of maximum allowable rotational speed and/or maximum allowable mass flow rate, an operating point for a take-off or landing operation and/or for cruise flight.

By a certain combination of the initially substantially independent design parameters of total blade count and total pressure ratio, a particularly advantageous, in particular low-noise, efficient and/or compact turbofan aircraft engine can be designed if specific minimum values are met for both the total pressure ratio and one or more stage pressure ratios of the second turbine and if the total stage count is within a narrowly defined range.

Accordingly, the second turbine of a turbofan aircraft engine may be designed such that the quotient of the total blade count $N_{BV}$ of the second turbine divided by 110, in particular divided by 100, is less than the difference of the total pressure ratio ($p_1/p_2$) of the second turbine minus one, where the total pressure ratio ($p_1/p_2$) of the second turbine is greater than 4.5, e.g., greater than 5, and at least one stage pressure ratio Π, e.g., each stage pressure ratio, of the second turbine is at least 1.5, e.g., at least 1.6, or at least 1.65, and where the total stage count $n_{St}$ of the second turbine is at least two and not greater than five, e.g., not greater than four.

Additionally or alternatively to such a combination of total blade count and total pressure ratio in conjunction with the consideration of limits for the total pressure ratio on the one hand and the total stage count on the other hand in accordance with the above conditions a particularly advantageous, in particular low-noise, efficient and/or compact turbofan aircraft engine can also be designed by a certain combination of the initially substantially independent design parameters of total pressure ratio and total stage count.

In particular, in accordance with a further aspect of the above turbofan aircraft engine, which may be combined with any of the aspects described above, the second turbine of a turbofan aircraft engine may be designed such that a quotient of the total pressure ratio ($p_1/p_2$) divided by the total stage count $n_{St}$ is greater than 1.6, e.g., greater than 1.65.

Moreover, a particularly advantageous, in particular low-noise, efficient and/or compact turbofan aircraft engine can be designed if a parameter defined by the product of the exit area of the second turbine and the square of the rotational speed of the second turbine at the design point is not less than a certain threshold value, and if, in addition, specific minimum values are met for both the stage pressure ratio of one or more turbine stages of the second turbine and the blade tip velocity of the turbine stage, particularly of the first or last turbine stage, of the second turbine at the design point.

Accordingly, in accordance with another aspect of the above turbofan aircraft engine, the second turbine of the turbofan aircraft engine may be designed such that the product of the exit area ($A_L$) of the second turbine and the square of the rotational speed n of the second turbine at the design point; i.e., in particular, the product of the exit area and the square of the maximum allowable rotational speed $n_{max}$, is at least $4.5\cdot10^{10}$ [in$^2$·rpm$^2$] or 8065 [m$^2$/s$^2$], e.g., at least $5\cdot10^{10}$ [in$^2$·rpm$^2$] or 8961 [m$^2$/s$^2$]:

$$A\cdot n^2(\max)\geq 4.5\cdot10^{10}\ [\text{in}^2\cdot\text{rpm}^2]$$

or respectively, $$A\cdot n^2(\max)\geq 5\cdot10^{10}\ [\text{in}^2\cdot\text{rpm}^2],$$

where at least one stage pressure ratio Π, e.g., each stage pressure ratio, of the second turbine is at least 1.5, e.g., at least 1.6, or at least 1.65, and the blade tip velocity $u_{TIP}$ of at least one turbine stage, particularly of the first or last turbine stage, of the second turbine at the design point is at least 400 meters per second, e.g., at least 450 meters per second.

As used herein, a blade tip velocity $u_{TIP}$ of a turbine stage is understood to mean, in particular, the maximum velocity of a radially outermost tip of a blade of the rotor blade array of the turbine stage in the circumferential direction at the design point; i.e., in particular, at maximum allowable rotational speed.

BRIEF DESCRIPTION OF THE DRAWING

The only FIGURE shows, in partially schematic form, a turbofan aircraft engine of a passenger jet according to an embodiment of the present invention as set forth above.

DETAILED DESCRIPTION OF EMBODIMENTS OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show details of the present invention in more detail than is necessary for the fundamental understanding of the present invention, the description in combination with the drawing making apparent to those of skill in the art how the several forms of the present invention may be embodied in practice.

FIG. 1 depicts a turbofan aircraft engine of a passenger jet in accordance with an embodiment of the present invention. The engine has a primary duct C containing a combustion chamber BK. The primary duct has a first turbine or high-pressure turbine HT, which is located immediately downstream (to the right in FIG. 1) of the combustion chamber and includes a plurality of turbine stages. The high-pressure turbine is fixedly coupled to a high-pressure compressor HC of the primary duct via a hollow shaft W1, and hence such that they rotate at the same speed, the high-pressure compressor being disposed immediately upstream of the combustion chamber. As used herein, a coupling providing for rotation at the same speed is understood to mean, in particular, a non-rotatable coupling having a constant gear ratio equal to one, such as is provided, for example, by a fixed connection.

The turbofan aircraft engine has a secondary duct B, which is arranged fluidically parallel to and concentric with the primary duct. A fan F is disposed immediately upstream of the primary and secondary ducts (to the left in FIG. 1) to draw in air and feed it into the primary and secondary ducts. An additional compressor or low-pressure compressor is disposed between the fan and the high-pressure compressor.

The fan is connected through a speed reduction mechanism including a transmission G and via a low-pressure shaft W2 to a second turbine or low-pressure turbine L of the primary duct. The low-pressure turbine includes a plurality of turbine stages and is disposed downstream of the high-pressure turbine (to the right in FIG. 1). The hollow shaft W1 is concentric with the low-pressure shaft W2.

The following are specific examples of alloys (a) which can be used from making the blade of the present invention (figures in each case represent at. %), and can also comprise small amounts of further elements as unavoidable impurities:

| Mo | Si | B | Ti | Fe | Y | Zr | Nb | W |
|---|---|---|---|---|---|---|---|---|
| 49.5 | 12.5 | 8.5 | 27.5 | 2.0 | 0 | 0 | 0 | 0 |
| 48.5 | 13.5 | 8.5 | 26.5 | 2.0 | 0 | 1.0 | 0 | 0 |
| 51.0 | 10.0 | 8.5 | 27.5 | 2.0 | 0 | 1.0 | 0 | 0 |
| 46.5 | 12.5 | 8.5 | 27.5 | 2.0 | 2.0 | 1.0 | 0 | 0 |
| 46.5 | 12.5 | 8.5 | 27.5 | 2.0 | 2.0 | 0 | 1.0 | 0 |
| 46.5 | 12.5 | 8.5 | 27.5 | 2.0 | 2.0 | 0 | 0 | 1.0 |
| 49.3 | 13.5 | 5.5 | 27.5 | 1.2 | 0 | 0 | 0 | 1.0 |

The following are specific examples of alloys (b) which can be used from making the blade of the present invention (figures in each case in % by weight). The balance to 100% by weight is constituted by Ni as main component and unavoidable impurities. Additionally, one or more of C, Si, Mn, P, S, B, Cu, Fe, Hf, Zr and Y may be present in a total concentration of less than 0.7% by weight.

| Al | Co | Cr | Mo | Re | Ru | Ta | Ti | W |
|---|---|---|---|---|---|---|---|---|
| 5.9 | 11.2 | 4.6 | 1.1 | 6.4 | 5.0 | 7.6 | 0 | 4 |
| 5.7 | 11.4 | 5.0 | 1.9 | 6.0 | 3.3 | 5.8 | 1.2 | 3.7 |
| 5.9 | 11.4 | 5.0 | 2.2 | 6.0 | 3.3 | 6.5 | 0.5 | 3.7 |
| 5.9 | 11.3 | 5.0 | 2.4 | 6.0 | 3.3 | 7.4 | 0 | 3.7 |

Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMERALS $A_B$ inlet area of the secondary duct
$A_C$ inlet area of the primary duct
$A_L$ exit area of the low-pressure turbine
B secondary duct (bypass)
BK combustion chamber
C primary duct (core)
$D_{Ba}$ outer diameter of the secondary duct
$D_{Bi}$, inner diameter of the secondary duct
$D_{Ca}$ outer diameter of the primary duct
$D_{Ci}$ inner diameter of the primary duct
$D_F$ maximum blade diameter of the fan
$D_L$ maximum blade diameter of the low-pressure turbine
F fan
G transmission (speed reduction mechanism)
HC (high-pressure) compressor
HT first turbine or high-pressure turbine
L second turbine or low-pressure turbine
V volume
W1 hollow shaft
W2 low-pressure shaft

What is claimed is:

1. A blade for a turbine of an aircraft engine, wherein the blade is made of a Mo-based alloy strengthened by intermetallic silicides which comprises molybdenum, silicon, boron and titanium as main constituents and further comprises one or both of iron and yttrium as minor alloying elements.

2. The blade of claim 1, wherein the alloy further comprises one or more of zirconium, niobium and tungsten as additional minor alloying elements.

3. The blade of claim 1, wherein the alloy comprises from 0.3 to 3 at. % iron.

4. The blade of claim 1, wherein the alloy comprises 0.3 to 2 at. % yttrium.

5. The blade of claim 1, wherein the alloy comprises a matrix of a molybdenum mixed crystal and one or more silicide phases.

6. The blade of claim 5, wherein the one or more silicide phases comprise $(Mo,Ti)_5Si_3$ and/or $(Mo,Ti)_5SiB_2$.

7. The blade of claim 6, wherein the alloy comprises from 15 to 35 vol. % of $(Mo,Ti)_5Si_3$, from 15 to 35 vol. % of $(Mo,Ti)_5SiB_2$, and from 1 to 20 vol. % of one or more minor phases.

8. The blade of claim 1, wherein the alloy comprises from 9 to 15 at. % of silicon, from 5 to 9 at. % of boron, and from 25 to 33 at. % of titanium.

9. The blade of claim 1, wherein the alloy comprises from 13 to 14 at. % of silicon, from 5 to 6 at. % of boron, and from 26 to 29 at. % of titanium.

10. The blade of claim 9, wherein the alloy comprises from 0.5 to 3 at. % iron.

11. The blade of claim 9, wherein the alloy comprises from 0.5 to 2 at. % yttrium.

12. The blade of claim 1, wherein a thermal expansion coefficient of the alloy in a temperature range from 20 to 1200° C. is not higher than $9\times10^{-6}$ 1/K.

13. The blade of claim 1, wherein a true density of the alloy is not higher than 8.5 g/cm$^3$.

14. A turbine for an aircraft engine, wherein the turbine comprises at least one blade according to claim 1.

15. An aircraft engine, wherein the engine comprises a turbine according to claim 14.

16. An aircraft engine, wherein the engine comprises (i) a first turbine and (ii) a second turbine disposed downstream of (i) and having a plurality of turbine stages, at least a first stage of the plurality of turbine stages comprising at least one blade according to claim 1.

17. The aircraft engine of claim 16, wherein the engine is a turbofan aircraft engine.

18. The aircraft engine of claim 17, wherein the engine comprises a primary duct including a combustion chamber; the first turbine (i) disposed downstream of the combustion chamber; a compressor disposed upstream of the combustion chamber and coupled to the first turbine; and the second turbine (ii) disposed downstream of the first turbine (i) and coupled to a fan for feeding a secondary duct of the aircraft engine.

19. The aircraft engine of claim 18, wherein the blades of the first stage of (ii) are not cooled.

* * * * *